US006667717B2

(12) United States Patent
Mitsui

(10) Patent No.: US 6,667,717 B2
(45) Date of Patent: Dec. 23, 2003

(54) PLANAR INVERTED F ANTENNA

(75) Inventor: Tsutomu Mitsui, Yokohama (JP)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/117,544

(22) Filed: Apr. 5, 2002

(65) Prior Publication Data

US 2002/0149525 A1 Oct. 17, 2002

(30) Foreign Application Priority Data

Apr. 17, 2001 (JP) ..... 2001-118186

(51) Int. Cl.[7] ..... H01Q 11/12
(52) U.S. Cl. ..... 343/700 MS; 343/702
(58) Field of Search ..... 343/700 MS, 742, 343/826, 867, 702, 797, 829, 846, 848

(56) References Cited

U.S. PATENT DOCUMENTS 6,542,128 B1 * 4/2003 Johnson et al. ..... 343/742

* cited by examiner

*Primary Examiner*—James Clinger
(74) *Attorney, Agent, or Firm*—Dilworth & Barrese, LLP

(57) ABSTRACT

A planar inverted F antenna with stable radiation characteristics, which is not vulnerable to ambient influence, having, an insulator, a radiation device formed on one surface of the insulator and a grounding plate formed on the other surface thereof. A coaxial cable has a central conductor electrically connected to the radiation device and an outer conductor electrically connected to the grounding plate at two points spaced from each other by approximately a quarter of the wavelength of current flowing through the outer conductor. If leakage current flows along the outer conductor, the leakage current is negated by an inverse-phase current flowing through the grounding plate.

4 Claims, 4 Drawing Sheets

PLANAR INVERTED F ANTENNA

PRIORITY

This application claims priority to an application entitled "Planar Inverted F Antenna" filed in the Japanese Patent Office on Apr. 17, 2001 and assigned Ser. No. 2001-118186, the contents of which are herein incorporated by reference.

BACKGROUND OF THE INVENTION

1. Field of the Invention

The present invention relates to a planar inverted F antenna (PIFA) having stable radiation characteristics for use in a portable terminal.

2. Description of the Related Art

Mono-pole antennas and planar inverted F antennas have been used for small size devices such as portable terminals.

FIG. 5 is a perspective view of a conventional planar inverted F antenna. Referring to FIG. 5, a planar insulator 1 has a radiation device 2 on a portion of one surface thereof and a grounding plate 3 as wide as the radiation device 2 on the other surface thereof. The radiation device 2 is connected to the grounding plate 3 via a conductor 8. A central conductor 5 of a coaxial cable 4 is electrically connected to the radiation device 2 and an outer conductor 6 of the coaxial cable 4 is electrically connected to the grounding plate 3.

The radiation characteristics of the planar inverted F antenna shown in FIG. 5 depend on the size and shape of the grounding plate 3. Therefore, the size of the grounding plate 3 is set or antenna characteristics are adjusted according to the grounding plate 3.

If the above planar inverted F antenna is to be disposed in a small space, the grounding plate 3 needs to be made smaller. However, scaling-down the size of the grounding plate 3 causes impedance mismatch and increases the vulnerability to electrical interference from adjacent circuits or metal components. As a result, the radiation characteristics of the antenna are deteriorated or the antenna operates at an incorrect resonant frequency.

In FIG. 5, if the grounding plate 3 becomes too small, a leakage current, which is not observed with a sufficiently large grounding plate, flows through the outer conductor 6 of the coaxial cable 4. In this state the radiation device 2 and the grounding plate 3 exhibit characteristics of a dipole antenna, that is, the miniaturized groundling plate 3 is virtually connected to the coaxial cable 4 and the radiation device 2 not by an unbalanced feed line but by a balanced feed line. The leakage current flowing through the coaxial cable 4 deteriorates the antenna's characteristics and renders the antenna vulnerable to ambient influences.

If an antenna is attached to a side of the cover of a laptop computer that co-functions as a display, its ambient environment has different influences over the antenna in a closed state (a standby state) and in an open state. When antenna characteristics are adjusted in one of the states, the antenna is influenced by nearby objects in the other state. Thus, leakage current changes and impedance mismatch is generated. As a result, the resonant frequency of the antenna is changed or its radiation characteristics deteriorate.

SUMMARY OF THE INVENTION

It is, therefore, an object of the present invention to provide a planar inverted F antenna which is not vulnerable to ambient influence although the antenna is made smaller.

It is another object of the present invention to provide a planar inverted F antenna that exhibits stable radiation characteristics.

The above and other objects of the present invention are achieved by providing a planar inverted F antenna with stable radiation characteristics, which is not vulnerable to ambient influence. In the planar inverted F antenna, an insulator has a radiation device formed on one surface and a grounding plate formed on the other surface thereof. A coaxial cable has a central conductor electrically connected to the radiation device and an outer conductor electrically connected to the grounding plate at two points spaced from each other by approximately a quarter wavelength of current flowing through the outer conductor. If leakage current flows along the outer conductor, the leakage current is negated by an inverse-phase current flowing through the groundling plate.

It is preferred that the groundling plate has a length of about a quarter wavelength of the current flowing through the outer conductor.

It is preferred that the insulator is formed of a dielectric material having a high dielectric constant.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described hereinbelow with reference to the accompanying drawings. In the following description, well-known functions or constructions are not described in detail since they would obscure the invention in unnecessary detail.

A planar inverted F antenna is designed to negate the leakage current flowing along the outer conductor of a coaxial cable and current flowing through a grounding plate according to an embodiment of the present invention.

Figure 1:
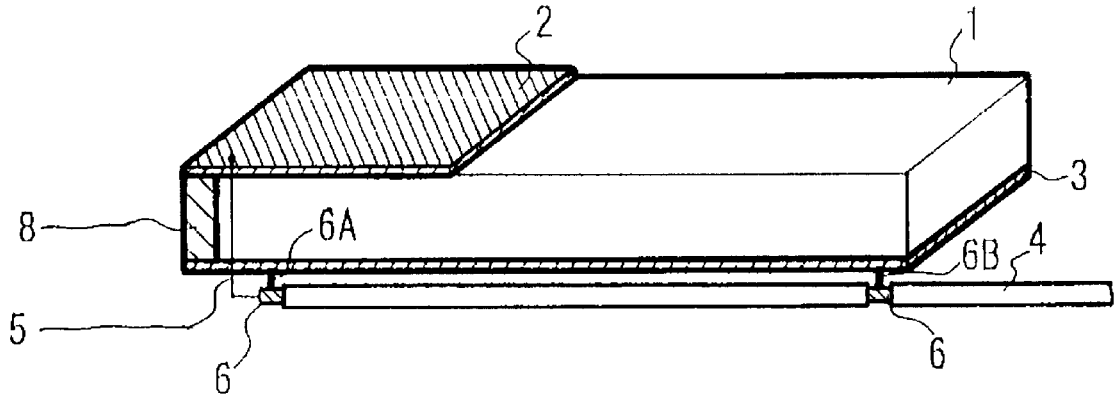
FIG. 1 is a perspective view of a planar inverted F antenna according to an embodiment of the present invention.

FIG. 1 is a perspective view of a planar inverted F antenna according to the embodiment of the present invention. Referring to FIG. 1, reference numeral 1 denotes an insulator, for example, a glass epoxy substrate, shaped into a parallelepiped. According to the embodiment of the present invention, the insulator 1 can be thin so long as it has two opposing surfaces. A radiation device 2 is formed on a portion of one of the surfaces of the insulator 1. A quarter-wavelength grounding plate 3 is formed on the surface of the insulator 1, opposite to the radiation device 2. Quarter-wavelength grounding plate 3 is electrically connected to the radiation device 2 via a conductor 8. The term "quarter-wavelength" is used to define the length of the grounding plate. The length of the grounding plate according to the preferred embodiment of the present invention is approximately equal to one-quarter of the wavelength of the signal transmitted or received by the device, i.e., the current flowing through an outer conductor 6.

Reference numeral 4 denotes a coaxial cable used to supply power to the radiation device 2. The coaxial cable 4 has a central conductor 5 electrically connected to the radiation device 2. An outer conductor 6 of coaxial cable 4 is electrically connected to the grounding plate 3 at contact points 6A and 6B. Contact points 6A and 6B are connectors that electrically connect grounding plate 2 with the outer conductor 6 of coaxial cable 4. The contact points 6A and 6B are spaced from each other by approximately a quarter wavelength of the current flowing through the grounding plate 3. The length of the coaxial cable 4 between contact points 6A and 6B is also approximately a quarter of the wavelength.

That is, the path length of the grounding plate 3 between the contact point 6A and the contact point 6B is approximately a quarter of the wavelength of the current flowing through the grounding plate 3, and the length of the coaxial cable 4 between the contact points 6A and 6B is also approximately a quarter of the wavelength of current flowing through the outer conductor 6 of the coaxial cable 4.

Figure 2:
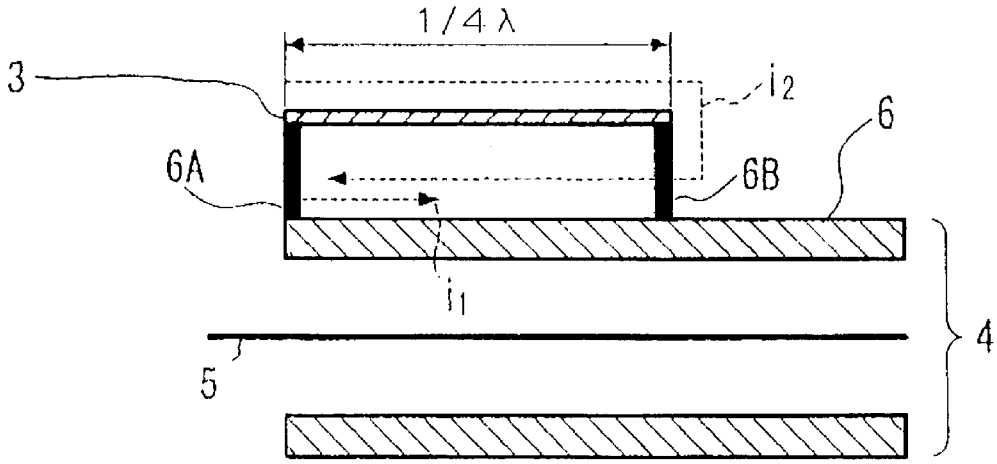
FIG. 2 conceptually illustrates the operation of the planar inverted F antenna according to the embodiment of the present invention.

Now, a description will be made of the operation mechanism of the planar inverted F antenna according to the preferred embodiment of the present invention with reference to FIG. 2. In FIG. 2, reference numeral i1 denotes leakage current flowing from the contact point 6A along the outside of the outer conductor 6. Reference numeral i2 denotes feedback current that flows from the contact point 6A along the grounding plate 3 and then returns from the contact point 6B through the outer conductor 6 to the contact point 6A.

In addition to the leakage current flowing along the outside of conductor 6, the leakage current i1 also flows from the outer conductor 6 of the coaxial cable 4 through contact point 6A along the grounding plate 3 and reaches the contact point 6B as the feedback current i2. The feedback current i2 is fed back from the contact point 6B to the contact point 6A along the outside of the outer conductor 6 of the coaxial cable 4. The feedback current i2 runs for about a half wavelength, that is, the quarter wavelength of grounding plate 3 and the quarter wavelength of outer conductor 6. Therefore, the phase difference between the leakage current i1 and the feedback current i2 at the contact point 6A is 180°. This results in a cancellation of the leakage current i1 by the feedback current i2 at contact point 6A. With the resulting negation of the leakage current i1 and the feedback current i2, virtually no leakage current i1 flows. As a result, the leakage current-caused deterioration of the radiation characteristics of the antenna is overcome.

The SWR (Standing Wave Ratio) frequency characteristics of the planar inverted F antenna will be described considering them in an open state (in use) and in a closed state (standby state), when the antenna is attached to a side of an LCD (Liquid Crystal Display) mounted to the cover of a laptop computer.

Figure 3:
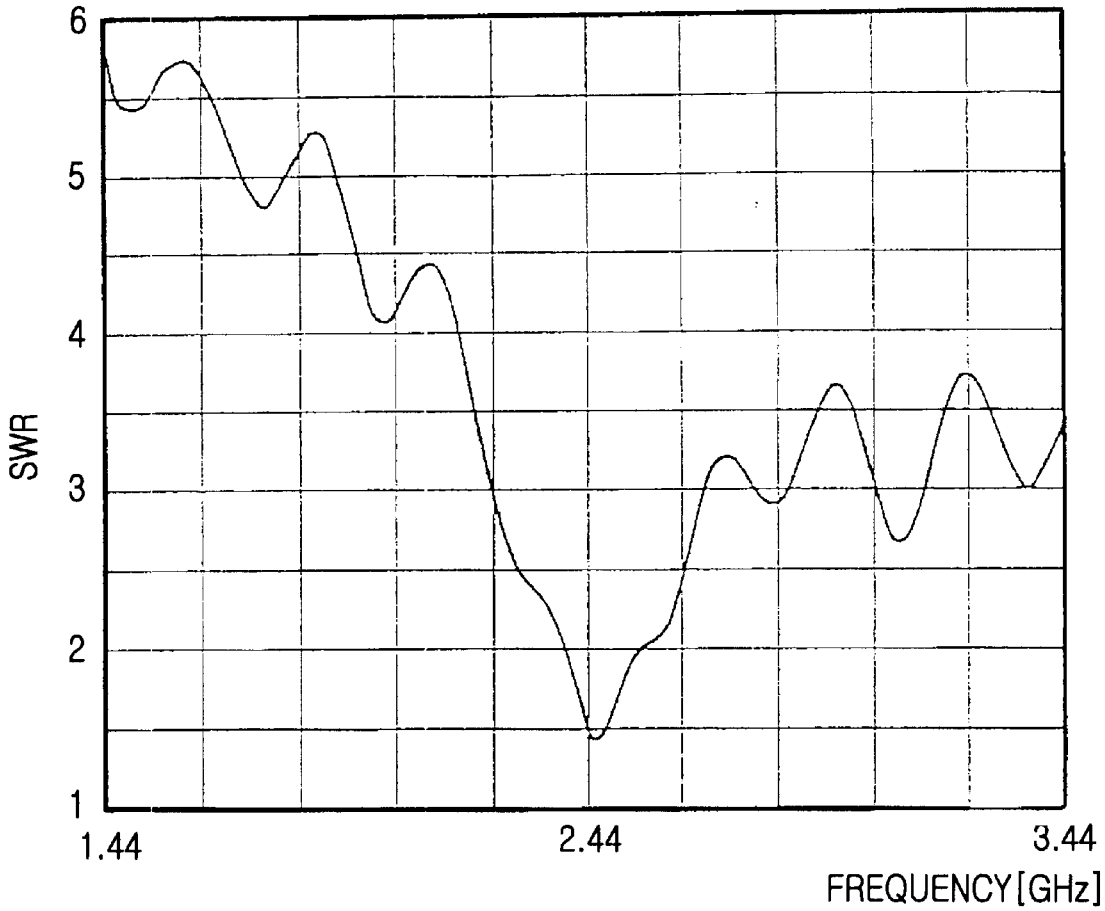
FIG. 3 is a graph showing the radiation characteristics of the planar inverted F antenna in an open state of the cover of a laptop computer when the antenna is installed in the laptop computer according to the embodiment of the present invention.
Figure 4:
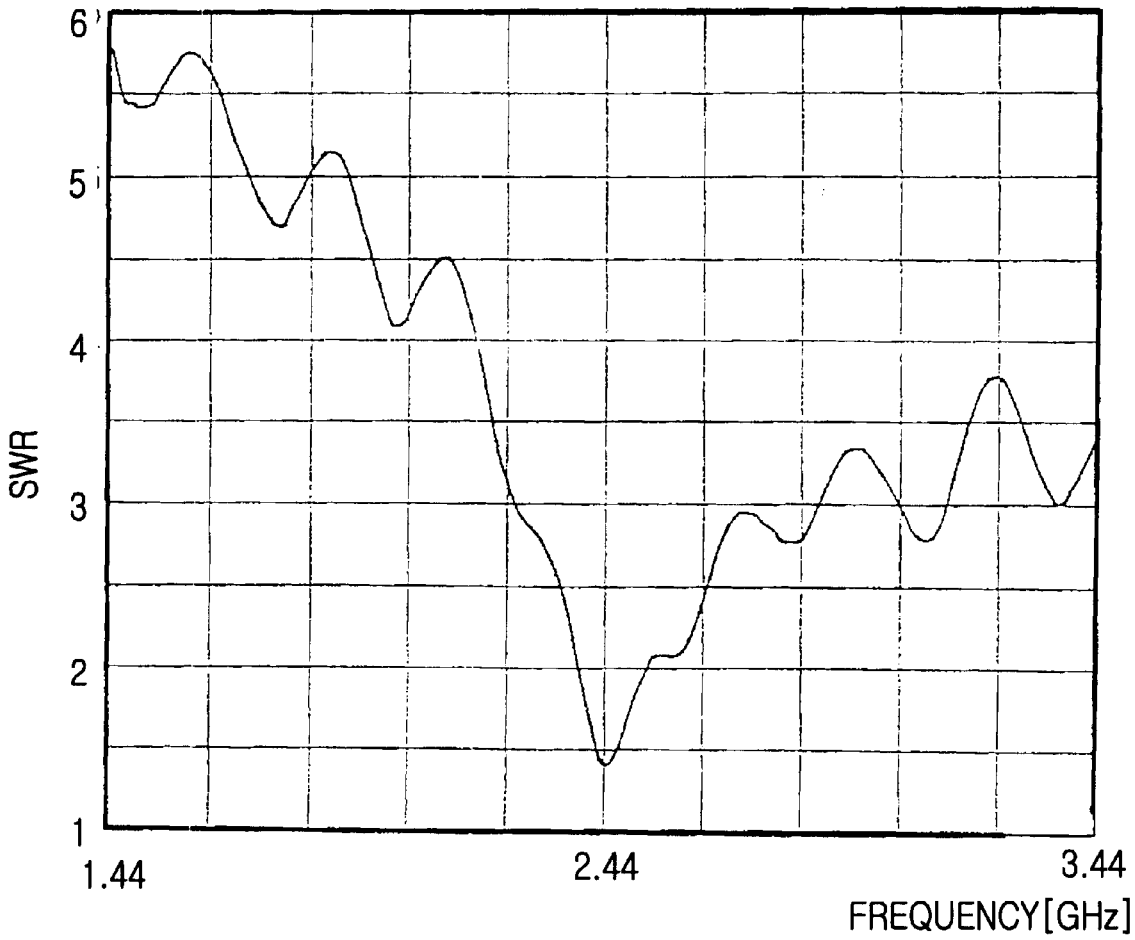
FIG. 4 is a graph showing the radiation characteristics of the planar inverted F antenna in a closed state of the cover of the laptop computer according to the embodiment of the present invention.
Figure 5:
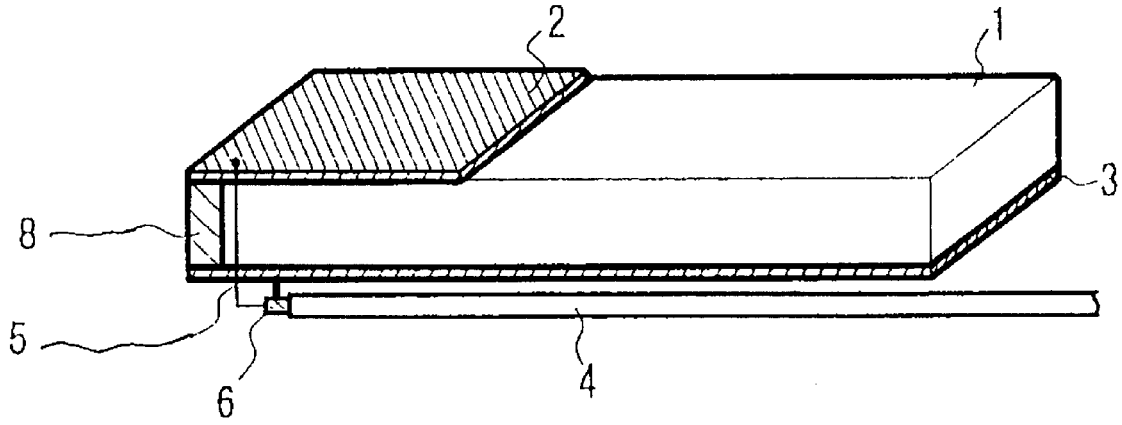
FIG.5 (PRIOR ART)
FIG. 5 is a perspective view of a conventional planar inverted F antenna.

FIGS. 3 and 4 are graphs showing SWR versus frequency when the cover of the laptop computer is opened and closed, respectively. As seen from FIGS. 3 and 4, power supplied to the antenna is reflected most efficiently at the smallest SWR and a frequency for the SWR is the resonant frequency of the antenna.

A frequency with the smallest SWR is 2.44 GHz both in an open state and in a closed state, as shown in FIGS. 3 and 4.

The resonant frequency of the planar inverted F antenna is the same whether the cover of the laptop computer is opened or closed. That is, the planar inverted F antenna of the present invention is not susceptible to ambient influence and exhibits stable radiation characteristics, even though it is miniaturized.

While in the preceding example a glass epoxy substrate was used as the insulator 1 due to its low cost and availability, the insulator 1 can be formed of any material having a high dielectric constant such as ceramic, to thereby further miniaturize the antenna.

In accordance with the present invention as described above, the outer conductor of the coaxial cable is connected to the grounding plate at two points spaced from each other by approximately a quarter wavelength of the current flowing through the outer conductor. Therefore, leakage current flowing along the outer conductor can be eliminated, and the radiation characteristic of the planar inverted F antenna can be improved. Furthermore, since stable radiation characteristics are achieved even with a miniaturized grounding plate, the antenna can be made smaller without deteriorating its radiation characteristics. As a result, installation efficiency is increased.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A planar inverted F antenna comprising:

an insulator plate having a top and a bottom surface;

a radiation device formed on the top surface of the insulator plate;

a grounding plate formed on the bottom surface of the insulator plate; and a coaxial cable having a central conductor electrically connected to the radiation device and an outer conductor having a first outer conductor connecting point and a second outer conductor connecting point separated by a first distance electrically connected to the grounding plate; having a first grounding plate connecting point and a second grounding plate connecting point separated by a second distance;

wherein said first outer conductor connecting point is electrically connected to said first grounding conductor plate, said second outer conductor connecting point is electrically connected to said second grounding conductor plate, and said first distance and said second distance are approximately a quarter of a wavelength of a current flowing through said outer conductor.

2. The planar inverted F antenna of claim 1, wherein the groundling plate has a length of approximately a quarter of the wavelength of the current flowing through the outer conductor.

3. The planar inverted F antenna of claim 1, wherein the insulator is formed of a dielectric material having a high dielectric constant.

4. A planar inverted F antenna comprising:

an insulator plate having a top and a bottom surface;

a radiation device formed on the top surface of the insulator plate;

a grounding plate formed on the bottom surface of the insulator plate; and a coaxial cable having a central conductor electrically connected to the radiation device and an outer conductor having outer conductor connecting points electrically connected to the grounding plate;

wherein said outer conductor connecting points are spaced with approximately a quarter of a wavelength interval of a current flowing through said outer conductor.

* * * * *